US008064624B2

(12) United States Patent
Neugebauer et al.

(10) Patent No.: US 8,064,624 B2
(45) Date of Patent: Nov. 22, 2011

(54) METHOD AND APPARATUS FOR GENERATING A STEREO SIGNAL WITH ENHANCED PERCEPTUAL QUALITY

(75) Inventors: Bernhard Neugebauer, Erlangen (DE); Jan Plogsties, Erlangen (DE); Harald Popp, Tuchenbach (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 954 days.

(21) Appl. No.: 12/029,776

(22) Filed: Feb. 12, 2008

(65) Prior Publication Data

US 2009/0022328 A1 Jan. 22, 2009

Related U.S. Application Data

(60) Provisional application No. 60/953,284, filed on Aug. 1, 2007.

(30) Foreign Application Priority Data

Jul. 19, 2007 (DE) ..... 10 2007 033 977

(51) Int. Cl.
*H04R 5/00* (2006.01)
*H04R 5/02* (2006.01)

(52) U.S. Cl. ..... 381/310; 381/17

(58) Field of Classification Search ..... 381/17, 381/18, 309, 310, 61, 63, 303
See application file for complete search history.

(56) References Cited

U.S. PATENT DOCUMENTS

| | | | | |
|---|---|---|---|---|
| 5,671,287 | A | 9/1997 | Gerzon | |
| 7,177,431 | B2 * | 2/2007 | Davis et al. | 381/1 |
| 7,391,870 | B2 * | 6/2008 | Herre et al. | 381/23 |
| 7,646,875 | B2 * | 1/2010 | Schuijers et al. | 381/23 |
| 7,917,236 | B1 | 3/2011 | Yamada | |
| 2004/0136554 | A1 | 7/2004 | Kirkeby | |
| 2006/0008089 | A1 | 1/2006 | Willems | |
| 2006/0210087 | A1 * | 9/2006 | Davis et al. | 381/17 |

FOREIGN PATENT DOCUMENTS

EP 0 991 298 A2 4/2000

(Continued)

OTHER PUBLICATIONS

Official communication issued in counterpart International Application No. PCT/EP2008/003972, mailed on Sep. 12, 2008.

(Continued)

*Primary Examiner* — Lincoln Donovan
*Assistant Examiner* — Alexander Talpalatskiy
(74) *Attorney, Agent, or Firm* — Keating & Bennett, LLP

(57) ABSTRACT

A stereo signal with enhanced perceptual quality using a mid-signal and a side-signal, can be generated, when a enhanced side signal is created prior to the upmix of the stereo signal. A decorrelated representation of at least a portion of the sum signal and/or a decorrelated representation of at least a portion of the side-signal is generated. The enhanced side-signal is generated combining a representation of the side-signal with the decorrelated representation of the portion of the mid signal, with the decorrelated representation of the side-signal and the decorrelated representation of the portion of the mid-signal or with the portion of the mid-signal and the decorrelated representation of the portion of the side-signal. The stereo signal with enhanced perceptual quality is created using a representation of the mid-signal and the enhanced side-signal.

22 Claims, 6 Drawing Sheets

FOREIGN PATENT DOCUMENTS

Figure 1:
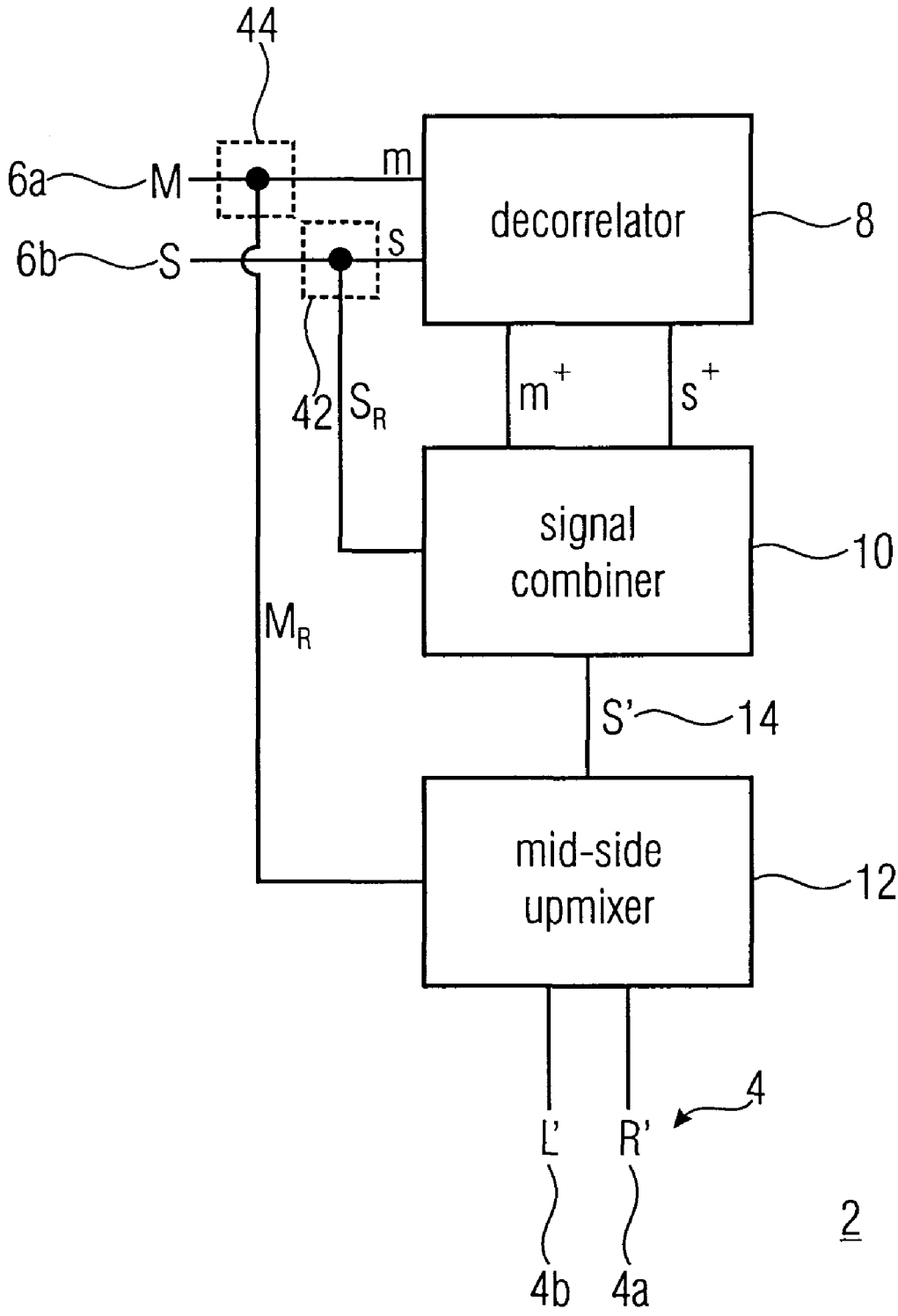

| | | | |
|---|---|---|---|
| EP | 1 194 007 | A2 | 4/2002 |
| EP | 1 906 705 | A1 | 4/2008 |
| JP | 2000-115899 | A | 4/2000 |
| KR | 10-2005-0057559 | A | 6/2005 |
| WO | 00/45619 | A1 | 8/2000 |
| WO | 2004/030410 | A1 | 4/2004 |
| WO | 2005/098825 | A1 | 10/2005 |
| WO | 2007/010771 | A1 | 1/2007 |

OTHER PUBLICATIONS

Bauer: "Stereophonic Earphones and Binaural Loudspeakers," Journal of the Audio Engineering Society; Apr. 1961; vol. 9; No. 2; pp. 148-151.
Bauer: "Improving Headphone Listening Comfort," Journal of the Audio Engineering Society; vol. 13; No. 4; pp. 300-302; Oct. 1965.
Iwanaga et al.: "Embedded Implementation of Acoustic Field Enhancement for Stereo Sound Sources," IEEE; Transactions on Consumer Electronics; pp. 737-741; Aug. 2003.
Rubak: "Headphone Signal Processing System for Out-of-The Head Localization," 90th Convention of the Audio Engineering Society, Paris, Preprint 3063; 25 pages; 1991.
Choi et al.: "Efficient Out of Head Localization System for Mobile Applications," Audio Engineering Society; Convention Paper 6758; pp. 1-7; Presented at the 120th Convention; Paris; May 20-23, 2006.
Kirkeby: "A Balanced Stereo Widening Network for Headphones," 22nd International Conference on Virutal, Synthetic and Entertainment Audio; Finland; pp. 1-4; 2002.
Cooper et al.: "Prospects for Transaural Recording," Journal of the Audio Engineering Society; vol. 37; No. 1/2; pp. 3-19; Jan./Feb. 1989.
Schroeder: "An Artificial Stereophonic Effect Obtained From Using a Single Signal," Presented at the 9th Annual Meeting of the AES; 17 pages; Oct. 1957.
Kendall: "The Decorrelation of Audio Signals and Its Impact on Spatial Imagery," Computer Music Journal; vol. 19; No. 4; pp. 71-87; 1995.
Schroeder: "Natural Sounding Artificial Reverberation," Presented at the 13th Annual Meeting of AES; 18 pages; Oct. 1961.
Stautner et al.: "Designing Multi-Channel Reverberators," Computer Music Journal; vol. 6; No. 1; pp. 52-65; 1982.
Official Communication issued in corresponding Singapore Patent Application No. 200908722-2, mailed on Apr. 14, 2011.
English translation of Official Communication issued in corresponding Japanese Patent Application No. 2010-516377, mailed on Jul. 12, 2011.
English translation of Official Communication issued in corresponding Korean Patent Application No. 10-2010-7000658, delivered on Mar. 28, 2011.

* cited by examiner

METHOD AND APPARATUS FOR GENERATING A STEREO SIGNAL WITH ENHANCED PERCEPTUAL QUALITY

Embodiments of the present invention relate to the creation of a stereo signal with enhanced perceptual quality and in particular, to how a signal represented by a mid-signal and a side-signal can be processed to create a stereo-signal with improved characteristics.

BACKGROUND OF THE INVENTION

Recently, it has become feasible to store and playback larger amounts of music on portable devices. As a consequence, the use of such devices became very popular, especially as the musical content can be played back via headphones everywhere. Normally, the content to be played back has been mixed in stereo, i.e., to two independent channels. However, the production has been performed for a playback via loudspeakers, using a common two-channel stereo-equipment. That is, the stereo-channels have been mixed in a music-studio such as to provide maximum reproduction quality, and, as far as possible, the spatial perception of the original auditory scene using two loudspeakers. However, listening to such stereo recordings via headphones leads to in-head localization of the sound, that is to a strongly disturbing spatial impression. In other words, virtual sound sources, which are meant to be localized somewhere between the two loudspeakers, are localized inside the listener's head due to psychoacoustic properties of the human auditory system. This is the case since no crosstalk and no reflexions are perceived, which irritates the auditory system such that the sound sources is localized in the listener's head. The irritation is caused since the auditory system is used to those signal properties, when content is played back via loudspeakers, or, more generally, transmitted via a "real" environment.

Several methods and devices have been proposed to address this problem by processing the left and right channels prior to the playback via headphones. However, these approaches, as for example the use of head related transfer functions, are computationally very complex. These approaches try to stimulate the human auditory system to localize the sound sources outside the head when playing back music with headphones by simulating the listening situation of loudspeakers in a room. That is, for example, a cross-talk sound path and the reflections of the room's walls are artificially added to the signal. To achieve a realistic simulation, filtering has to be applied to the left and the right channel to further take into account the properties of the listener's torso, head and pinnae. The more accurate this kind of simulation is, the more computational resources are required. When fairly well-sounding results are to be received with reduced complexity, those models are, for example, reduced to cross-talk, and, in some cases, to a very small number of wall reflections, which can be implemented by low-order filtering. The influence of the human body itself can also be approximated by low order filters. However, these filters have to be used on the direct signal as well as on each of the reflected signals (as e.g. described in M. R. Schroeder: An Artificial Stereophonic Effect Obtained from Using a Single Signal, $9^{th}$ annual meeting of the AES, preprint 14, 1957).

Other methods have been proposed to provide a stereophonic listening experience, even when only a monophonic signal is provided. One approach is to feed the input signal (monophonic) to both channels and to create an attenuated and delayed representation of the signal, which is then added to the first channel and subtracted from the second channel.

Often, stereo signals are also transformed in to a mid-side representation containing a mid-signal (sum-signal) and a side-signal (difference signal). The sum-signal is formed by summing up the right channel and the left channel and the difference signal is formed by building the difference of the left channel and the right channel. In most musical stereo-signals, the virtual sound sources of highest relevance are those localized in front of the listener. This is the case, since these commonly represent the leading voice or the leading instrument in the recording. As these sound sources are intended to be localized between the loudspeakers of a two-channel setup, these signal components are present in the left channel as well in the right channel. Therefore, these important signals are mainly represented by a sum-signal (mid-signal) and hardly by a different signal (side-signal). Therefore, when attempting to achieve a localization out of a listener's head, such a mid-side representation has to be processed with great care.

In conventional out-of-head signal processing based on sum and difference signals, the sum-signals remain either unprocessed, or are individually processed or filtered by specific filters. However, simply filtering the sum signal and the side signal separately, and redistributing the signals to the left and right channels leads to an increase of the out-of-head localization or the perceived spatial width at the cost of an unadvantageously high computational complexity. Furthermore, an adding (subtracting) of a filtered sum signal to the difference signal, as performed by a conventional mid-side-upmixer, results in a shift of the perceived position of the virtual sound sources within the output signal.

Given the conventional generation of stereo-signals and the changed playback habits, the need exists to provide a concept for the generation of a stereo signal with enhanced perceptual quality, which can be efficiently implemented.

SUMMARY OF THE INVENTION

Several embodiments of the present invention allow for the creation of a stereo signal with an enhanced perceptual quality based on a mid-signal (sum-signal) and a side-signal (difference signal). The out-of-head localization and the stage width of the sound signal is increased, when a signal portion of the mid-signal is mixed with a representation of the side-signal, provided that the signal portion of the mid-signal and the representation of the side-signal are, to a certain extent, mutually decorrelated. By performing the combination, an enhanced side-signal can be derived, which can be used as an input for a mid-side-upmixer creating a stereo-output-signal to be played back via headphones. By mixing parts of the mid-signal to the side-signal prior to upmixing, the perceptual width of the virtual audio sources in front of a listener's head can be increased, as a part of the signal is distributed to the side-channel containing information of sound sources not directly in front of the listener. However, in order to avoid a perceived left- or right-shift of the auditory scene or of the virtual sound sources, the signals to be combined are mutually decorrelated, in order to distribute constructive or destructive interference of the signal irregularly within the spectrum. To be more precise, after the decorrelation of the signal, different parts of the spectrum of the signals interfere differently. In order to achieve this, a decorrelator is adapted to generate a decorrelated representation of at least a portion of the mid-signal and/or a decorrelated representation of at least a portion of the side-signal.

By using decorrelated representations of parts of the signals which are mixed together with the side signal, the played back stereo signal has an enhanced perceptual quality, in that the signal is no longer localized within the head, when listened to with headphones. In order to achieve the effect, a decorrelated representation of a portion of the mid-signal may be provided and mixed to the side-signal.

According to further embodiments, a decorrelated representation of at least a portion of the sum-signal is provided as well as a decorrelated representation of at least a portion of the side-signal. Both decorrelated representations are combined (mixed) with the side-signal or with a representation of the side-signal derived by modifying the provided side-signal.

According to a further embodiment, a portion of the mid-signal is combined with a representation of the side-signal wherein at least a portion of the side-signal is decorrelated with respect to the portion of the mid-signal. This may be achieved by creating a decorrelated representation of the portion of the side-signal before combining the thus created decorrelated representation with the side-signal.

According to a further embodiment, the high-frequency portions of the signals are decorrelated, in order to process only those frequency portions of an audio-signal, that cause, due to the relatively short wavelength, significant reflection-induced-effects to a listener. This avoids introduction of disturbing artifacts into low-frequency-parts of the signal.

In further embodiments, audio processors implementing the above concept are used within audio decoders, such that a mid-side-representation of a two-channel signal created as an intermediate signal in a decoder can be directly processed enhancing the perceptual quality of the generated stereo-signal. To this end, further embodiments of the present invention are adapted to process the mid-signal and the side-signal in a frequency domain, such that frequency representations of the respective signals can be directly processed without the need of retransforming them into a time domain representation. This can be of great benefit when, for example, audio decompressor are used, which provide an intermediate signal being a mid-side-representation of an underlying stereo-signal within the frequency domain. That is, embodiments of the invention may be efficiently implemented within, for example, MP3 and AAC-decoders, or the like, such as to increase the perceptual quality of mobile playback devices providing the signal to headphones.

To summarize, several embodiments of the present invention use a novel audio processing method for generating stereo signals, which avoids localization inside the head when the generated signal is played back via headphones. The method yields this high perceptual quality, that is, the possibility of generating a stereo signal with an advanced perceptual quality, while keeping other properties of the signal, such as the spectral distribution and the transient behavior, perceptually unaffected. Furthermore, the spatial perception is improved in terms of out of head localization and stage width while preserving the distribution of the sound sources. Due to the low computational complexity, embodiments of the invention can be easily used on portable music playback devices, in spite of the limited processing power and power supply of those devices.

BRIEF DESCRIPTIONS OF THE DRAWINGS

Figure 2:
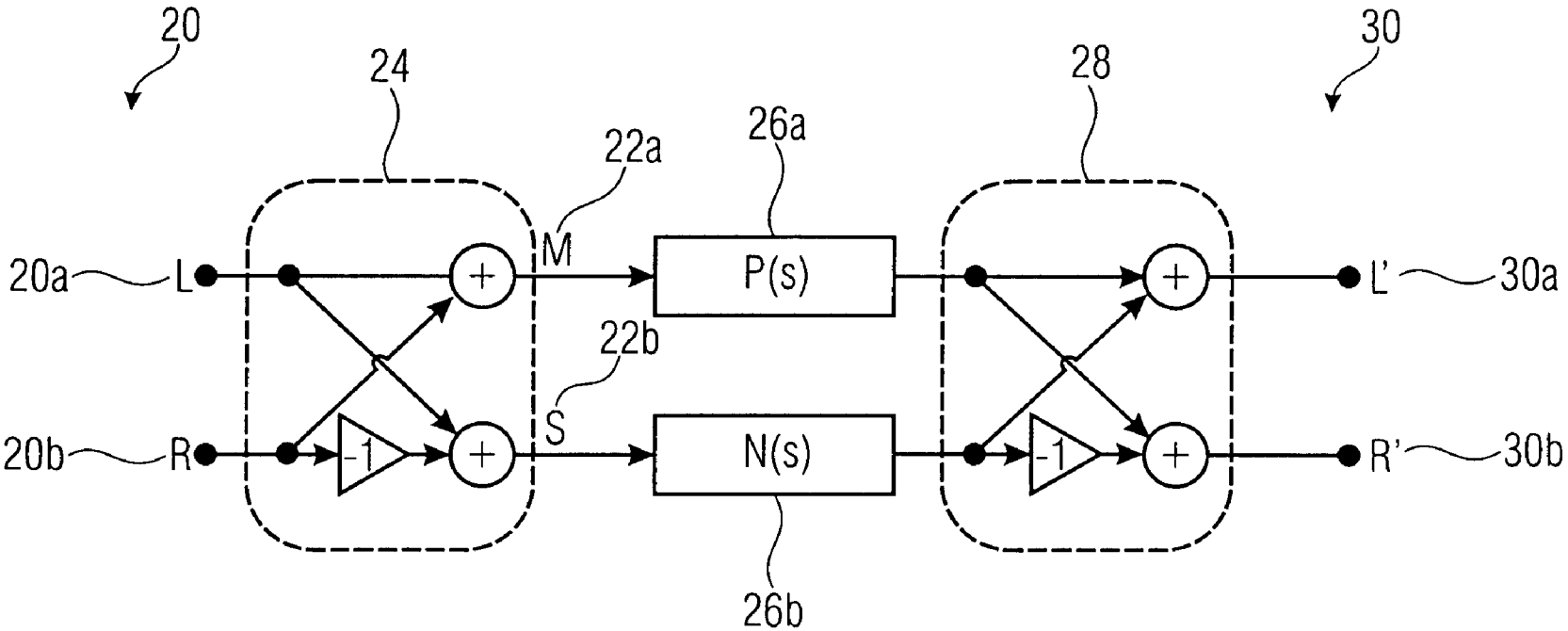
Figure 3:
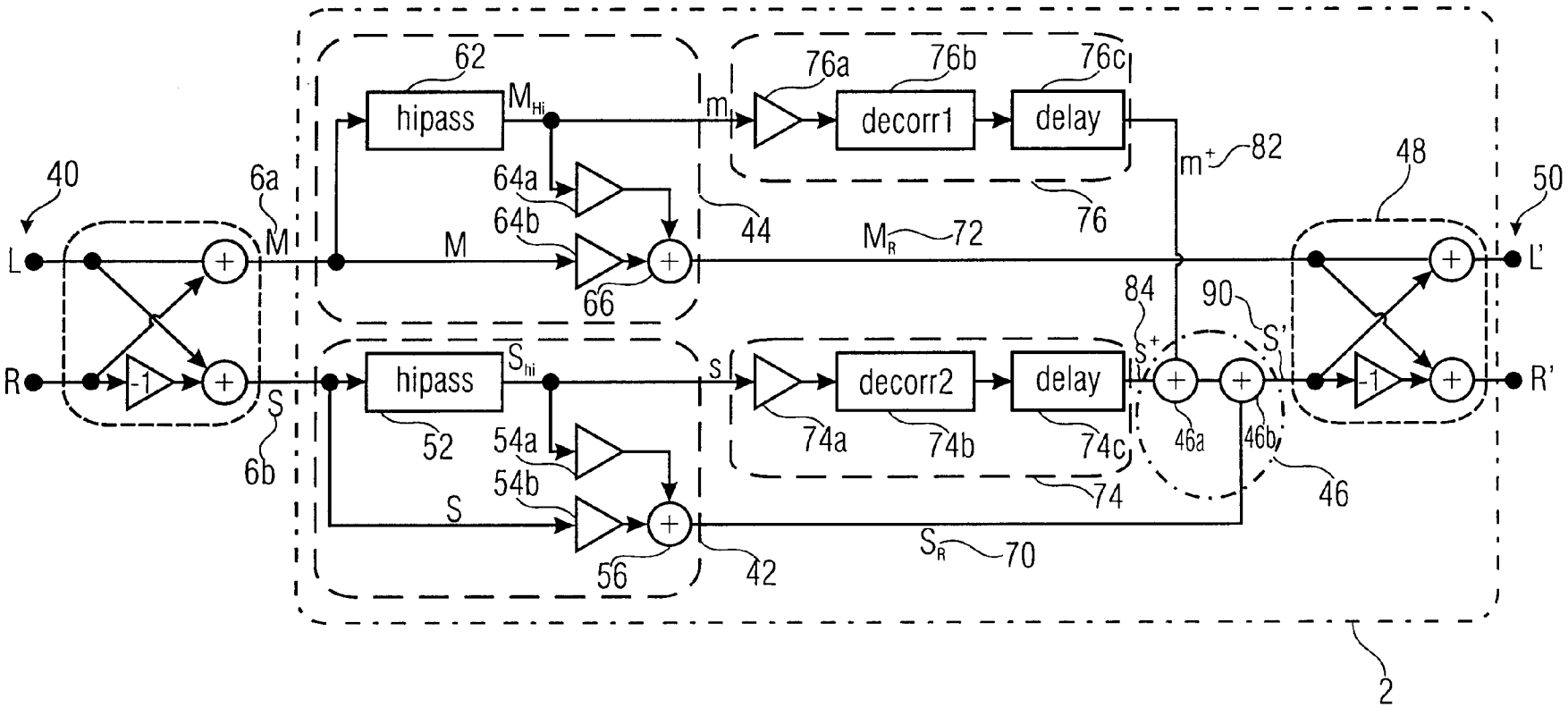
Figure 4:
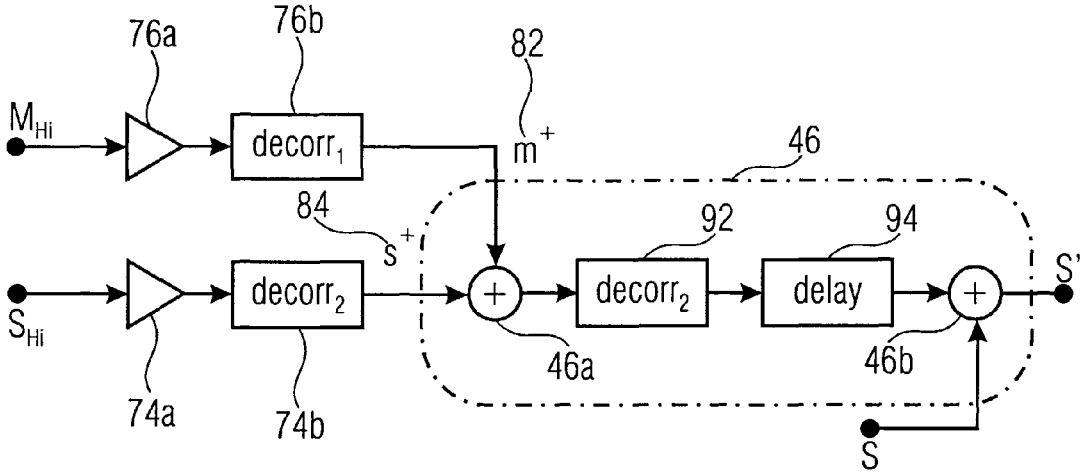
Figure 5:
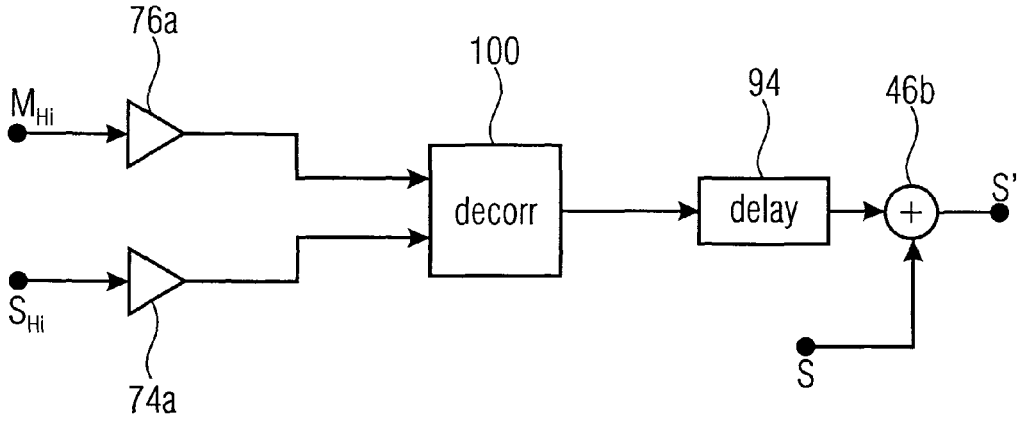
Figure 6:
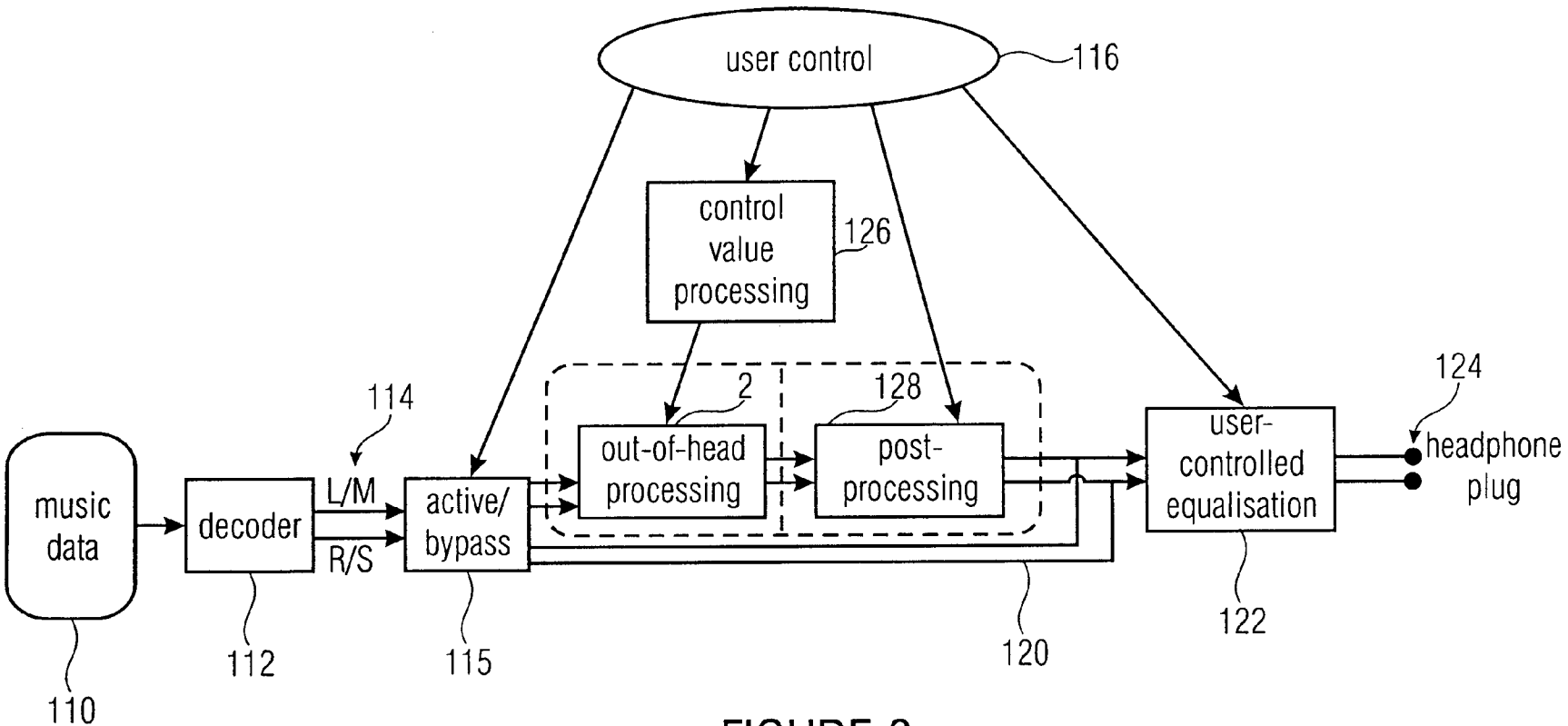

Several embodiments of the present invention will in the following be described referencing the enclosed figures, showing:

FIG. 1 an embodiment of an audio processor;

FIG. 2 an example of a conventional two-channel stereo mixer;

FIG. 3 an embodiment of an audio processor using decorrelated signal portions of the mid-signal and of the side-signal;

FIG. 4 a further alternative decorrelator setup;

FIG. 5 an embodiment using an integrated decorrelator setup;

FIG. 6 an embodiment of an audio decoder; and

Figure 7:
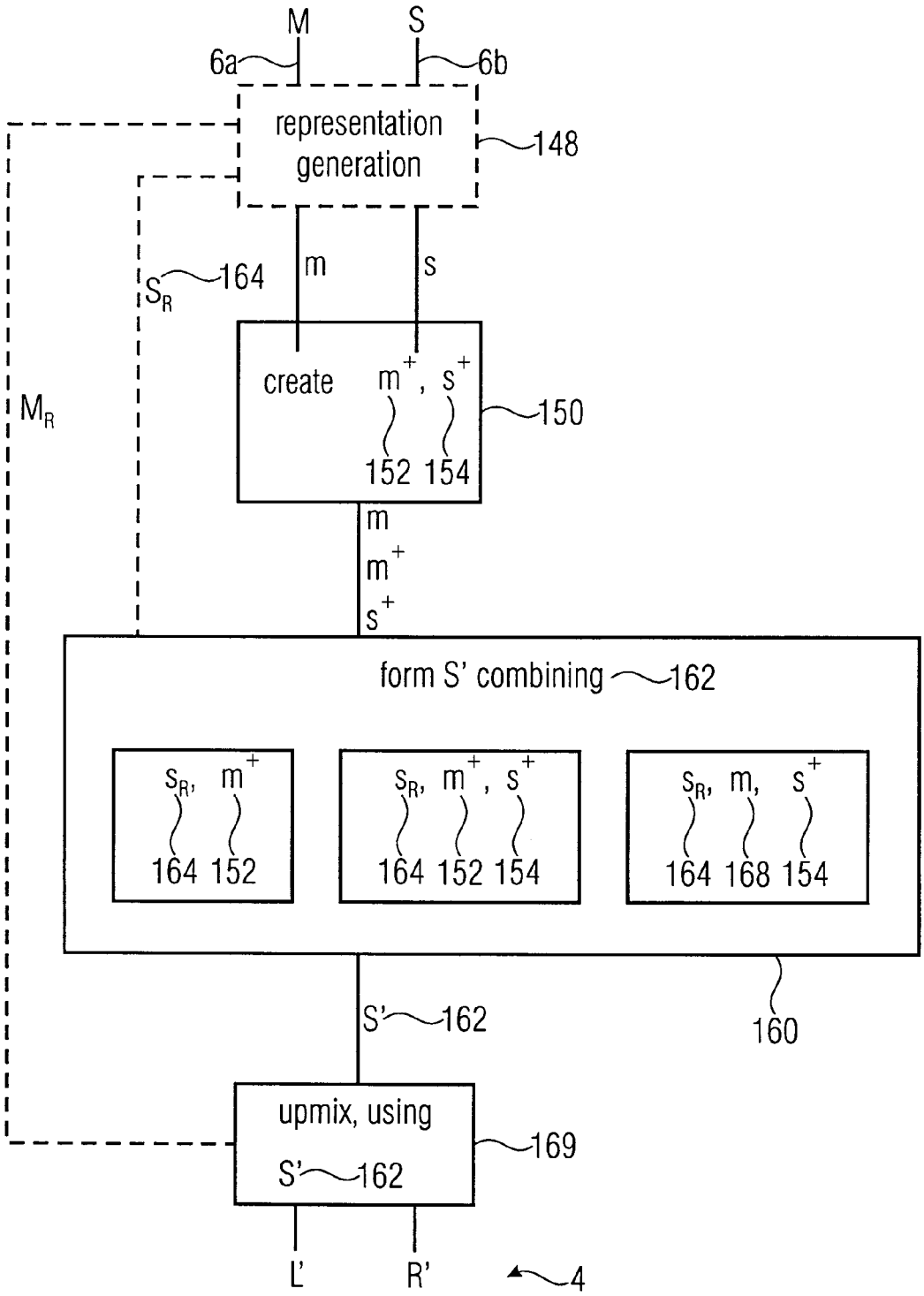

FIG. 7 an embodiment of a method for generating a stereo signal.

DETAILED DESCRIPTION OF THE DRAWINGS

FIG. 1 shows an embodiment of an audio processor 2 for generating a stereo signal with enhanced perceptual quality 4, comprising a right-channel 4*a* and a left-channel 4*b*. The stereo signal 4 is generated based on a mid-signal 6*a* and a side-signal 6*b*, provided to the audio processor 2. It should be noted, that here and in the context of this application, the mid- and side-signals M and S are understood to be either the M- and S-signals created by summing up and building the difference of an original left and right channel, or being a signal based on those M- and S-signals, that is, being modifications of same signals. The modifications, however, are only based on the original mid- and side-signals. That is, a modified side-signal is generated using only the side-signal and a modified mid-signal is generated using only the mid-signal. To this end, modified mid-signals and side-signals are also referred to as representations of the mid-signal $M_R$ and the side-signal $S_R$.

The audio processor 2 comprises a decorrelator 8, a signal combiner 10 and a mid-side-upmixer 12. The decorrelator 8 receives the mid-signal 6*a* and the side-signal 6*b* as an input, or alternatively, representations of same signals. Alternatively, the decorrelator 8 may in some embodiments derive a representation of the mid-signal and side-signal 6*b* itself. The decorrelator is adapted to generate a decorrelated representation of at least a portion of the mid-signal and/or a decorrelated representation of at least a portion of the side-signal. According to some embodiments, the portion of the signals, which is decorrelated, is a high-pass-filtered part of the original signals, such as to provide the processing only in those frequency ranges, where the processing yields a perceptual improvement.

In alternative embodiments, optional representation generators 42 and 44 may be present, which receive the original mid-signal 6*a* and the original side-signal 6*b* as an input and which create the representations of the mid-signal ($M_R$) and the side-signal ($S_R$) as well as the representations m and s provided to the decorrelators.

The decorrelated representations derived by the decorrelator 8 are input into the signal combiner 10, which furthermore receives the side-signal or a representation of the side signal $S_R$. The signal combiner 10 derives an enhanced side-signal 14, based on a combination of the signals provided to the signal combiner. According to one embodiment, the combination can be performed using the representation of the side-signal $S_R$ and a decorrelated representation of a portion of the mid-signal $m^+$. According to a further embodiment, the combination can be based on the side-signal $S_R$, a decorrelated representation of a portion of the side-signal $s^+$ and a decorrelated representation of a portion of the mid-signal $m^+$. According to a further embodiment, the combination can be based on the side-signal $S_R$, a portion of the mid-signal m (which is not decorrelated) and a decorrelated representation of at least a portion of the side-signal $s^+$.

According to some embodiments, the portion of the sum-signal and the portion of the side-signal are corresponding signal portions, that is, for example, represent the same frequency range. That is, in deriving those portions, high-pass-filters using the same filter characteristics are used.

The signal combiner 10 thus derives an enhanced side-signal 14 (S'), which has a contribution of the mid-signal. This contribution and the side-signal are mutually decorrelated (at least in the frequency range of interest) such that possible constructive or destructive interferences are distributed irregularly within the spectrum when the signal portions are combined subsequently in the mid-side upmixer 12. The mid-side-upmixer 12 receives on the one hand the enhanced side-signal 14, and, on the other hand, the mid-signal $M_R$ or a representation of the mid-signal 6*a* as an input. The mid-side upmixer derives the stereo signal 4 having the enhanced perceptual quality, especially when played back by headphones.

In several embodiments of the invention, the upmixer uses an upmixing rule, according to which the left-channel of the stereo signal is created by summing up the enhanced side-signal and the mid-signal. In these embodiments, the right-channel 4*a* is formed by building the difference between the mid-signal 6*a* (or the representation of the mid-signal $M_R$) and the enhanced side-signal 14.

With the embodiment of an audio processor disclosed in FIG. 1, signal portions of the mid-signal are distributed to the side-signal prior to an upmix. In other words, the processing of the mid-signal and the side-signal in the mid-side-signal-domain is interleaved, resulting in an out-of-head localization of the thus processed signal, which is hardly achievable using conventional mid-side-signal processing techniques when the computational complexity is an issue.

FIG. 2 shows an example of conventional signal processing in which a stereo signal 20 (having a left channel 20*a* and a right channel 20*b*) is transformed into a mid-signal 22*a* and a side-signal 22*b*, using a conventional mid-side-synthesizer 24. The mid-signal 22*a* is filtered using a first filter 26*a* and the side-signal 22*b* is filtered using a second filter 26*b*. The filtered representations of the mid-signal 22*a* and the side-signal 22*b* are upmixed using a mid-side-upmixer 28 to derive a processed stereo-signal 30 (having a left-channel L' 30*a* and a right-channel R' 30*b*.

However, as the processing is not interleaved, a perceptual widening of the auditory scene or a localization out of a listener's head can hardly be achieved without significantly increasing the computational complexity of the signal processing.

FIG. 3 shows an embodiment of the invention using a decorrelated representation of a part of the mid-signal as well as a decorrelated representation of a part of the side-signal. The original stereo-signal 40 is transformed into a representation having a mid-signal 6*a* and a side-signal 6*b*, using a mid-side-synthesizer 24.

The signal processor 2 operates on the mid-signal 6*a* and the side-signal 6*b* thus provided. The signal processor 2 comprises a first representation generator 42 for the side-signal 6*b* and a second representation generator 44 for the mid-signal 6*a*. A signal combiner 46 of the audio processor 2 comprises a first summation-node 46*a* and a second summation-node 46*b*. The audio processor further comprises a mid-side upmixer 48, generating the stereo signal with enhanced perceptual quality 50 at the output of the audio processor 2.

The representation generators 42, 44 use their respective input signals, i.e., the mid-signal 6*a* and the side-signal 6*b* to generate representations $M_R$ and $S_R$ of those signals by adding or subtracting a high-pass-filtered signal portion of the input signals to the input signals themselves, thereby emphasizing or attenuating the high-frequency-portions of those signals. To this end, the first representation generator 42 comprises a high-pass-filter 52, a first signal scaler 54*a* and a second signal scaler 54*b*, and a summation node 56. The second representation generator 44 comprises a high-pass-filter 62, a third signal scaler 64*a* and a fourth signal scaler 64*b*, as well as a summation node 66.

The signal scalers 54*a*, 54*b* and 64*a*, 64*b* are operative to scale the signals at their inputs, i.e., to apply a scale factor to the signals by multiplying the signals with the scale factor. The high-pass-filter 52 of the first representation generator 42 receives a copy of the side-signal 6*b* as its input and provides a high-pass-filtered signal portion $S_{Hi}$ at its output. The high-pass-filtered signal portion $S_{Hi}$ is input into the first signal scaler 54*a*, whereas the side-signal 6*b*, or a copy of the signal is input into the second signal scaler 54*b*.

The scaling factors of the signal scalers 54*a* and 54*b* can be predetermined or may, in further embodiments, be subject to a user interaction. The summation node 56 receives the scaled high-pass-filtered signal portion $S_{Hi}$ and the scaled side-signal to sum these signals, so as to provide a representation of the side-signal $S_R$ 70 at the output of the summation node 56 (the output of the first representation generator 42). In an analogous manner, the second representation generator 44 provides a representation of the mid-signal $M_R$ 72 as its output.

The audio processor further comprises a first decorrelation circuit 74 and a second decorrelation circuit 76. The first decorrelation circuit 74 comprises a scaler 74*a*, a decorrelator 74*b* and a delay-circuit 74*c* and the second decorrelation circuit 76 comprises a sixth signal scaler 76*a*, a decorrelator 76*b* and a delay circuit 76*c*.

It should be emphasized that the decorrelation structures 74 and 76 are to be understood as mere examples of possible decorrelation structures or decorrelators. In particular, a delay structure (delay circuits 76*c* and 74*c*) is not necessarily required. Instead, the decorrelators 74*b* and 76*b* can implement a certain amount of delay itself. According to further embodiments, the delay may be omitted. As already indicated in the previous paragraphs, the signal portions to be combined should be mutually decorrelated. Therefore, the decorrelators 74*b* (decorr 2) and 76*b* (decorr 1) may be different, in order to provide mutually decorrelated signals.

The scale factors of the signal scalers 74*a* and 76*a* can be predetermined or be subject to user manipulation. The decorrelators 74*b* and 76*b* generate a signal, which is, to a certain extent, decorrelated from the signal at their input. That is, a maximum of the absolute value of the normalized cross-correlation between a signal at the input of the decorrelator and the signal output by the decorrelator will be significantly lower than 1. It may be noted that the precise implementation of the decorrelators is of minor importance. Instead, different implementations of decorrelators known in the art can be used and also arbitrary combinations thereof. For example, various allpass-filters may be used. For example, a concatenation of second order IIR-filters could be used to provide a decorrelated representation of the high-pass-filtered portion of the mid-signal and the side-signal. Each filter may have arbitrary filter characteristics, which could, for example, be generated using a random generator. The decorrelation may be achieved with different kinds of decorrelators, as for example using reverberation algorithms, including for example, feedback delay networks. Feed-forward comb-filters and feed-back comb-filters may be used as well as allpass-filters, which could, for example, be combined from feed-forward and feedback comb-filters. Another implementation could, for example, use random noise to filter the signals at the input of the decorrelators, so as to provide decorrelated signals.

The decorrelation circuits 74 and 76 furthermore comprise delay-circuits 74*c* and 76*c*, which may apply an optional additional delay to the decorrelated signals generated by the decorrelators 74*b* and 76*b*. The decorrelation circuit 76 provides a decorrelated representation of a high-pass-filtered-signal portion of the mid-signal $M^+$82, whereas decorrelation circuit 74 provides a decorrelated representation of a high-pass filtered signal portion of the side-signal $s^+$84. In the particular example shown in FIG. 3, the signal combiner 46 combines the representation of the side-signal 70, the decorrelated representation of the portion of the side-signal 84 as well as the decorrelated representation of the portion of the mid-signal 82 by summing up these three components using the summation nodes 46*a* and 46*b*. In the particular example of FIG. 3, the decorrelated representation of the portion of the mid-signal 82 and the decorrelated representation of the portion of the side-signal 84 are combined first, e.g. by summing both signals using summation node 46*a*. Then the thus combined signal is combined with the representation of the side-signal 70, e.g. by summing both signals using summation node 46*b*. It may be noted that summing up could also be modified by scaling of the signals to be summed up prior to the combination (summation). By scaling with negative values, summation could effectively also result in building a difference. When deriving the enhanced side-signal 90, further decorrelation measures may additionally be implemented within the two summation nodes 46*a* and 46*b*.

In order to avoid evenly spaced constructive or destructive interference for all parts of the spectrum and in order to widen the perceptual impression of the audio scene, decorrelator 74*b* is used to provide the decorrelated representation of the side-signal 84 prior to the combination with the representation of the side-signal 70. In order to achieve the effect of out-of-head localization and spatial widening, the portion of the mid-signal, which is combined with the representation of the side-signal in order to form the enhanced side-signal, shall be decorrelated from the corresponding portion of the representation of the side-signal. This means that, when combining a high-pass-filtered portion $M_{Hi}$ of the mid-signal with a high-pass-filtered portion $S_{Hi}$ of the side-signal, the high-frequency portion $S_{Hi}$ of the side-signal and the high-frequency portion $M_{Hi}$ of the mid-signal should be decorrelated from each other. Optionally, both portions may be mutually decorrelated from the representation of the Side-signal 70.

However, alternate embodiments may directly combine the decorrelated representation of the mid-signal 82 with the representation of the side-signal 70, as these are mutually decorrelated due to decorrelator 76*b*.

Furthermore, alternative embodiments may combine the high-pass-filtered signal portion $M_{Hi}$ directly with a representation of the side-signal, when the high-frequency portion of the representation of the side-signal is decorrelated, such as to provide mutual decorrelation of the respective signal parts.

Given the previous alternatives, the filter characteristics of the high-pass-filters 52 and 62 may be identical as well as different.

Furthermore, the scale factors of the signal scalers 54*a*, 54*b*, 64*a*, 64*b*, 74*a* and 76*a* may vary within a wide scope. According to some embodiments, the scale factors are chosen such that the total energy of the signals M and S, i.e., the side-signal and the mid-signal is preserved within the generation of the representation of the mid-signal 72 and the enhanced side-signal 90.

When the effects of widening and out-of-head localization shall be increased, the scale factors may be chosen such that the enhanced side-signal 90 contains more energy or is louder than the side-signal 6*b*. In such a scenario the demand for energy preservation may require to attenuate the mid signal, i.e. to choose scale factors smaller than one. In case the phase shall be altered, appropriate scale factors may be smaller than zero.

Using an embodiment of an inventive audio processor, such as the one described in FIG. 3, a decorrelation of the high frequency part of the side-signal leads to a simple and efficient simulation of cross-talk and the diffused sound field of a virtual listening room.

According to some embodiments, it is, depending on the scale factor chosen, furthermore possible to reduce the low-frequency part of the mid-signal. This being a simple simulation of the cross-talk at low frequencies, where the sound waves are diffracted around the head of the listener. The incorporation of portions of the mid-signal into the out-of-head processing leads to a spatial extension of the front sources. Mixing of the decorrelated mid-signal $m^+$ to the side-signal S allows improved widening of a stereo image. Furthermore, the processing is extremely efficient, while leading to naturally sounding out-of-head processing of high perceptual quality and low complexity. The efficiency may be even further increased when the decorrelation of the portion of the mid-signal M and the side-signal S is combined, as detailed in the subsequent and preceding embodiments.

Summarizing, a specific embodiment of a signal processor can, in other words, be described as follows:

Provide a mid-signal M and a side-signal S. These may be provided externally, or internally within the signal processor, where original stereo signals or stereo channels L and R are summed up, such as to build the sum signal M and a difference signal S.

Then, create a high-pass-filtered signal path $S_{Hi}$. Add an scaled (attenuated or amplified) copy of the high-pass-filtered signal path $S_{Hi}$ to the attenuated main path S. Scale and decorrelate a copy of the high-pass-filtered signal path $S_{Hi}$ and/or delay this signal prior to adding it to the main path.

Further, process the sum-signal M as follows:

Create a high-pass-filtered signal path $M_{Hi}$ of the mid-signal M. Attenuate a copy of the high-pass-filtered signal $M_{HI}$ and add same to the attenuated main path M. Attenuate and decorrelate a further copy of $M_{Hi}$ and/or delay the same.

Then combine the signals by adding the attenuated, decorrelated and possibly delayed signal portion $M_{Hi}$ to the main path of the different signal S.

Finally, synthesize or create the output signals "L" and "R" by computing the sum or the difference of the main signal path S and the main signal path M.

As depicted in FIG. 4, the decorrelation of the high-frequency parts $M_{Hi}$, $S_{Hi}$ may be partially processed in one step. That is because the embodiments utilize signals which are mutually decorrelated, whereas different setups to result with decorrelated signals may be utilized.

As shown in FIG. 4, the decorrelated signal portions $m^+$ 82 and $s^+$ 84 of the high-frequency filtered signal portion $M_{Hi}$ and $S_{Hi}$ may be added by means of a summation node 46*a* prior to the application of a third decorrelator 92, which could furthermore be optionally followed by a delay circuit 94.

The combination to form the enhanced side-signal may then be performed after a combination of the decorrelated signals, as shown in FIG. 4. In order to guarantee mutually correlated signal portions, one of the three decorrelators 74*b*, 76*b*, or 92 may be omitted in further embodiments of the further invention.

A further decorrelation scheme is depicted in FIG. 5, utilizing a decorrelator 100 with multiple inputs. Using a decorrelator 100 with multiple inputs allows to provide the high-pass-filtered signal components $M_{Hi}$ and $S_{Hi}$ directly to the input of the decorrelator 100, which then performs the correlation and the combination of the generated signals, in accordance with, for example, the processing of FIG. 4. To this end, the decorrelator 100 could be understood to be a black-box, implementing, for example, the signal processing of FIG. 4. The decorrelator 100 could furthermore be followed by a delay-circuit 94, if a delay functionality is not included within the decorrelator 100.

In an alternative embodiment, a decorrelator 92 or 100 may provide multiple outputs being decorrelated with respect to each other, i.e., multiple mutually decorrelated outputs. In such a scenario, the output signals may, according to further embodiments, be directly fed to the left and right channels or to the representation of the mid-signal or the enhanced side-signal.

According to further embodiments, the decorrelation is performed in the spectral domain, such that the out-of-head processing, that is, the application of the inventive audio processors, can be efficiently included in the decoding of compressed audio signals, such as MP3 or AAC.

This may be highly beneficial, when a mid-side-representation of a stereo-channel signal is generated within the decoding process and/or when the decoding is performed in the spectral domain or in the spectral representation of the signals. A typical application scenario would be the implementation of embodiments of signal processors into portable music playback devices, such as for example, mobile phones or special multimedia playback devices.

One example of such an implementation is shown in FIG. 6. As shown in FIG. 6, music-data is stored or provided in an encoded representation 110 to a decoder 112, which decodes or decompresses music-data 110 to provide an input signal, which could, depending on the specific implementation, be a stereo signal comprising a left-channel and a right-channel or a mid-side-representation having a mid-channel and a side-channel. Furthermore, these representations can be provided in a time domain as well as in a spectral domain. In the signal processing or the reconstruction of audio data shown in FIG. 6, a user control allows access to some parameters of the system, as described below.

The input signal 114 is input into a bypass circuit, which, depending on the user input of the user control 116, bypasses an embodiment of an inventive signal processor 2, or feeds or forwards the signal 140 to the signal processor 2. The signal processor 2 provides the possibility to enhance the perceptual quality of the stereo signal, independent of its parameterization, i.e., regardless of the operation in the time- or the frequency-domain. When the signal is fed along a bypass-path 120, the unprocessed signal may be input into an optional equalizer 122, used to modify the signal dependent on user parameters provided by user control 116, so as to provide a headphone signal 124 at the output of the device. If, however, the bypass steers the signal to be input into the signal processor 2, out-of-head processing can be performed to derive a perceptually enhanced stereo-signal.

According to the embodiment of FIG. 6, the operation parameters such as scale factors or the threshold frequencies of high-pass filters of the signal processor 2 may be influenced or controlled by a user control 116, providing the control or steer values to a control value processing circuit 126, which may be implemented to cross-check the user input and to furthermore modify the user input parameters, such as to, for example, provide energy preservation of the processing.

After having been processed by the signal processor 2, an optional post-processing may be performed by a post-processor 128, which is optionally steerable by a user input provided via user control 116. Such post-processing, for example, comprises equalization or dynamics processing such as dynamic range compression or the like.

Summarizing, implementing signal processors into portable devices, in which musical content is usually stored in a compressed manner has several major advantages. After decoding of the compressed audio content, embodiments of inventive signal processors may be used, either to the PCM-data or to a frequency representation of same. Alternatively, the method can be integrated into the decoding of the compressed audio signals directly, either in the spectral or in the time domain. Optionally, a possibility to control the method or the signal processor may be implemented such as to switch the processing by the signal processor on and off. Furthermore, the parameters such as the scale factors used by the signal processors, may be adjustable by the user. To this end, a suitable set of control values may be provided, which are converted into the appropriate parameters by a processing step, that is, by a control value processor 126.

Furthermore, an optional post-processing, such as equalization or dynamics processing, may be applied to the improved signal. If the device itself provides a user-controlled equalization algorithm, this algorithm may additionally be applied to the output of the signal processor and/or to the output of the optional post-processing.

The output of the complete process chain, i.e., the output of an embodiment of a signal processor, or of the post-processing and/or the user-controlled equalization, is provided to the headphone plug of the music playback device.

FIG. 7 shows an embodiment of a method for generating a stereo signal 4 with enhanced perceptual quality, using a mid-signal 6*a* and a side-signal 6*b*. In a decorrelation step 150, a decorrelated representation of at least a portion of the mid-signal 152 and/or a decorrelated representation of at least a portion of the side-signal 154 is created.

In an enhancement step 160, an enhanced side-signal 162 (S') is created, combining a representation ($S_R$) of the side-signal 164 with the decorrelated representation of the portion of the mid-signal 152, with the decorrelated representation of the portion of the mid-signal 152 and the decorrelated representation of the portion of the side-signal 154, or with the portion of the mid-signal 168 and the decorrelated representation of the portion of the side-signal 154.

In an upmixing step 169, the stereo signal 4 with enhanced perceptual quality is derived, using in the enhanced side-signal 162 and a representation of the mid-signal $M_R$.

In an optional representation generation step 148, a representation of the mid- and/or the side-signals $M_R$ and $S_R$ as well as signal portions m and s of the mid-signal 6*a* and the side-signal 6*b* may be generated. Alternatively, the generation of those signal portions may be directly implemented within the remaining processing steps operating on the not pre-processed signals. That is, the step of the representation generation may be implemented within other steps of the method for generating a stereo signal.

Depending on certain implementation requirements of the inventive methods, the inventive methods can be implemented in hardware or in software. The implementation can be performed using a digital storage medium, in particular a disk, DVD or a CD having electronically readable control signals stored thereon, which cooperate with a programmable computer system such that the inventive methods are performed. Generally, the present invention is, therefore, a computer program product with a program code stored on a machine readable carrier, the program code being operative for performing the inventive methods when the computer program product runs on a computer. In other words, the inventive methods are, therefore, a computer program having a program code for performing at least one of the inventive methods when the computer program runs on a computer.

While the foregoing has been particularly shown and described with reference to particular embodiments thereof, it will be understood by those skilled in the art that various other changes in the form and details may be made without departing from the spirit and scope thereof. It is to be understood that various changes may be made in adapting to different embodiments without departing from the broader concepts disclosed herein and comprehended by the claims that follow.

What is claimed is:

1. Audio processor for generating a stereo signal with enhanced perceptual quality using a mid-signal and a side-signal, the mid-signal representing a sum of original left and right channels and the side-signal representing a difference of the original left and right channels, comprising:

a decorrelator adapted to generate a decorrelated representation of at least a portion of the mid-signal and/or a decorrelated representation of at least a portion of the side-signal;

a signal combiner adapted to generate an enhanced side-signal combining a representation of the side-signal with the decorrelated representation of the portion of the mid-signal, with the decorrelated representation of the side-signal and the decorrelated representation of the portion of the mid-signal or with the portion of the mid-signal and the decorrelated representation of the portion of the side-signal; and a mid-side upmixer adapted to generate the stereo signal with enhanced perceptual quality using a representation of the mid-signal and the enhanced side-signal.

2. Audio processor in accordance with claim 1, in which the signal combiner is adapted to build a weighted sum of the signals to be combined.

3. Audio processor in accordance with claim 1, in which the decorrelator is adapted to generate a decorrelated representation of a high-frequency portion of the mid-signal and/or of the side-signal.

4. Audio processor in accordance with claim 1, in which the decorrelator is adapted to decorrelate the portion of the mid-signal and/or the side-signal to derive a decorrelated signal.

5. Audio processor in accordance with claim 4, in which the decorrelator is further adapted to apply a predetermined delay to the decorrelated signals.

6. Audio processor in accordance with claim 1, in which the signal combiner is adapted to use the mid-signal and the side-signal as the signal representations to be combined.

7. Audio processor in accordance with claim 1, further comprising a representation generator for generating the representation of the side-signal using the side-signal and a high-pass-filtered signal portion of the side-signal.

8. Audio processor in accordance with claim 7, in which the representation generator further comprises a high-pass-filter adapted to generate the high-pass-filtered signal portion.

9. Audio processor in accordance with claim 8, in which the decorrelator is adapted to generate the decorrelated representation of the side-signal using the high-pass-filtered signal portion of the side signal.

10. Audio processor in accordance with claim 7, in which the representation generator further comprises a first and a second signal scaler to adapt an intensity of the side-signal and of the high-pass-filtered signal portion prior to the combination.

11. Audio processor in accordance with claim 1, further comprising a second representation generator for generating the representation of the mid-signal using the mid-signal and a high-pass-filtered signal portion of the mid-signal.

12. Audio processor in accordance with claim 11, in which the second representation generator further comprises a second high-pass-filter adapted to generate the high-pass-filtered signal portion of the mid-signal.

13. Audio processor in accordance with claim 12, in which the decorrelator is adapted to generate the decorrelated representation of the mid-signal using the high-pass-filtered signal portion of the mid-signal.

14. Audio processor in accordance with claim 11, in which the second representation generator further comprises a third and a fourth signal scaler to adapt the intensity of the mid-signal and of the high-pass-filtered signal portion of the mid-signal prior to the combination.

15. Audio processor in accordance with claim 1, which is adapted to use a frequency representation of the mid-signal and the side-signal.

16. Audio processor in accordance with claim 1, in which the mid-side upmixer is adapted to generate a left channel of the stereo signal with enhanced perceptual quality forming a weighted sum of the representation of the mid-signal and the enhanced side-signal and to generate the right channel of the stereo signal with enhanced perceptual quality forming a weighted difference between the representation of the mid-signal and the enhanced side-signal.

17. Method for generating a stereo signal with enhanced perceptual quality using a mid-signal and a side-signal, the mid-signal representing a sum of original left and right channels and the side-signal representing a difference of the original left and right channels, comprising:

generating a decorrelated representation of at least a portion of the mid-signal and/or a decorrelated representation of at least a portion of the side-signal;

generating an enhanced side-signal combining a representation of the side-signal with the decorrelated representation of the portion of the mid-signal, with the decorrelated representation of the side-signal and the decorrelated representation of the portion of the mid-signal or with the portion of the mid-signal and the decorrelated representation of the portion of the side-signal; and upmixing the representation of the mid-signal and the enhanced side-signal to derive the stereo signal with enhanced perceptual quality.

18. Method in accordance with claim 17, in which the generation of the enhanced side-signal comprises forming a weighted sum of the signals to be combined.

19. Method in accordance with claim 17, in which the decorrelated representations are generated from high-frequency portions of the mid-signal and/or the side-signal.

20. A non-transitory computer readable medium storing a computer program having a program code for performing, when running on a computer, a method for generating a stereo signal with enhanced perceptual quality using a mid-signal and a side-signal, the mid-signal representing a sum of original left and right channels and the side-signal representing a difference of the original left and right channels, comprising:

generating a decorrelated representation of at least a portion of the mid-signal and/or a decorrelated representation of at least a portion of the side-signal;

generating an enhanced side-signal combining a representation of the side-signal with the decorrelated representation of the portion of the mid-signal, with the decorrelated representation of the side-signal and the decorrelated representation of the portion of the mid-signal or with a portion of the mid-signal and the decorrelated representation of the portion of the side-signal; and upmixing the representation of the mid-signal and the enhanced side-signal to derive the stereo signal with enhanced perceptual quality.

21. Audio decoder for generating a stereo signal with enhanced perceptual qualities comprising:

a signal provider for providing a mid-signal and a side-signal, the mid-signal representing a sum of original left and right channels and the side-signal representing a difference of the original left and right channels; and an audio processor according to claim 1.

22. Audio decoder according to claim 21, in which the signal provider comprises an audio decompressor for generating the mid-signal and the side-signal by decompressing a compressed audio data stream.

* * * * *